US008448436B2

(12) United States Patent
Browne et al.

(10) Patent No.: US 8,448,436 B2
(45) **Date of Patent: *May 28, 2013**

(54) TUNABLE IMPEDANCE LOAD-BEARING STRUCTURES

(75) Inventors: Alan L. Browne, Grosse Pointe, MI (US); Nancy L. Johnson, Northville, MI (US); Nilesh D. Mankame, Ann Arbor, MI (US); Paul W. Alexander, Ypsilanti, MI (US); Hanif Muhammad, Ann Arbor, MI (US); Kenneth A. Strom, Washington, MI (US); James W. Wells, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/409,490

(22) Filed: Mar. 1, 2012

(65) Prior Publication Data

US 2012/0161921 A1 Jun. 28, 2012

Related U.S. Application Data

(62) Division of application No. 12/949,893, filed on Nov. 19, 2010, now Pat. No. 8,205,445, and a division of application No. 11/758,053, filed on Jun. 5, 2007, now abandoned.

(51) Int. Cl.
*F01B 29/10* (2006.01)

(52) U.S. Cl.
USPC ..... 60/528; 248/636; 267/154

(58) Field of Classification Search
USPC ..... 293/137; 248/580, 678, 188.1, 636; 52/167.1, 167.4, 167.7; 60/528; 267/154
See application file for complete search history.

(56) References Cited

U.S. PATENT DOCUMENTS

| | | | | | |
|---|---|---|---|---|---|
| 1,761,322 | A * | 6/1930 | Wells | 52/167.2 |
| 1,769,434 | A * | 7/1930 | Jones | 248/580 |
| 3,419,238 | A * | 12/1968 | Flory | 248/163.1 |
| 3,794,277 | A * | 2/1974 | Smedley et al. | 248/548 |
| 4,511,115 | A * | 4/1985 | Ludwigsen | 248/562 |
| 4,533,109 | A * | 8/1985 | Delam | 248/542 |
| 4,662,786 | A * | 5/1987 | Cherbonnier | 405/195.1 |
| 4,988,244 | A * | 1/1991 | Sheldon et al. | 409/132 |
| 5,035,307 | A * | 7/1991 | Sadeghi et al. | 188/372 |
| 5,310,157 | A * | 5/1994 | Platus | 248/619 |
| 5,388,935 | A * | 2/1995 | Sheldon | 409/201 |
| 5,466,085 | A * | 11/1995 | Sheldon et al. | 403/157 |
| 5,538,373 | A * | 7/1996 | Kirkham | 409/131 |
| 5,674,027 | A * | 10/1997 | Warnaar | 403/404 |
| 5,718,095 | A * | 2/1998 | Kemeny | 52/698 |
| 5,727,391 | A * | 3/1998 | Hayward et al. | 60/528 |
| 5,737,239 | A * | 4/1998 | Horiuchi et al. | 702/56 |
| H1833 | H * | 2/2000 | Hoppel et al. | 296/68.1 |
| 6,247,678 | B1 * | 6/2001 | Hines et al. | 251/11 |
| 6,966,602 | B2 * | 11/2005 | Mae | 296/187.03 |
| 7,029,044 | B2 * | 4/2006 | Browne et al. | 293/137 |
| 7,140,478 | B2 * | 11/2006 | Barvosa-Carter et al. | 188/267 |
| 7,392,876 | B2 * | 7/2008 | Browne et al. | 180/274 |
| 7,393,039 | B2 * | 7/2008 | Ravid et al. | 296/68.1 |

(Continued)

*Primary Examiner* — Brian Glessner
*Assistant Examiner* — Joshua Ihezie
(74) *Attorney, Agent, or Firm* — Quinn Law Group, PLLC

(57) ABSTRACT

A tunable impedance load bearing structure includes a support comprising an active material configured for supporting a load, wherein the active material undergoes a change in a property upon exposure to an activating condition, wherein the change in the property is effective to change an impedance characteristic of the support.

3 Claims, 4 Drawing Sheets

U.S. PATENT DOCUMENTS

| | | | | |
|---|---|---|---|---|
| RE40,914 | E * | 9/2009 | Taylor et al. | 606/56 |
| 7,669,918 | B2 * | 3/2010 | Buravalla et al. | 296/187.03 |
| 8,066,462 | B2 * | 11/2011 | Rudduck et al. | 411/360 |
| 2004/0195815 | A1 * | 10/2004 | Browne et al. | 280/753 |
| 2004/0217627 | A1 * | 11/2004 | Mae | 296/187.03 |
| 2006/0012191 | A1 * | 1/2006 | Brei et al. | 292/341.17 |
| 2006/0038643 | A1 * | 2/2006 | Xu et al. | 335/78 |
| 2006/0125291 | A1 * | 6/2006 | Buravalla et al. | 296/204 |
| 2009/0058130 | A1 * | 3/2009 | Ukpai et al. | 296/146.9 |
| 2009/0126288 | A1 * | 5/2009 | Fanucci et al. | 52/167.1 |
| 2010/0101050 | A1 * | 4/2010 | Cafeo et al. | 16/239 |
| 2011/0197394 | A1 * | 8/2011 | Cafeo et al. | 16/243 |

* cited by examiner

TUNABLE IMPEDANCE LOAD-BEARING STRUCTURES

CROSS-REFERENCE TO RELATED APPLICATION

This application is a divisional application of U.S. application Ser. No. 12/949,893, filed Nov. 19, 2010, which is a divisional application of U.S. application Ser. No. 11/758,053, filed Jun. 5, 2007, both of which are hereby incorporated by reference in their entireties.

BACKGROUND

The present disclosure generally relates to tunable impedance load bearing structures, and more particularly, to active material based tunable impedance load bearing structures.

Load bearing structures such as beams, columns, rails, cables, panels, brackets, and the like are typically designed to withstand various static and dynamic external and internal forces and moments while maintaining their shape and position within acceptable deformation tolerances. A critical characteristic of these structural applications is stiffness. Currently, stiffness characteristics of a given load bearing structure can be improved by optimizing structure geometry and/or materials to suit certain loading conditions (e.g., foam filling hollow cross sections of a load bearing structure). For dynamic applications, the damping characteristics of the material may play a more critical role. In the case of a load bearing structure which is experiencing vibratory excitation, the damping properties of the structure may be optimized so that its performance excels when excited at a single frequency. The improved performance of these structures, however, is designed around a specific set of loading conditions. As such, the structure may not perform as desired under loading conditions outside the set of specific conditions focused on during design and fabrication of the structure.

Moreover, the specific characteristics desired at the time of manufacture and/or installation of the load bearing structure may actually be detrimental in certain situations, i.e., under circumstances where dramatically different load bearing characteristics would be advantageous. One example of such a situation, not intended to be limiting, could be in the automotive industry, where load bearing structures are designed to perform in a relatively rigid manner during normal operation, but during extraordinary circumstances, such as in an impact event, a drastically more compliant or a drastically stiffer structure may be preferable. Prior art load bearing structures are unable to make such significant changes in characteristics, rather these structures simply provide a fixed response, which is inherent to the characteristics contemplated at the time of design. In other words, current load bearing structures are not tunable.

Accordingly, there is a need for an improved load bearing structure. It would be desirable for such an improved load bearing structure to exhibit tunable impedance characteristics, i.e., be able to variously change structural and or material characteristics to meet changing load requirements in order to improve performance across a wider range of service conditions.

BRIEF SUMMARY

Disclosed herein are tunable impedance load bearing structures comprising an active material. In one embodiment, a tunable impedance load bearing structure includes a support comprising an active material configured for supporting a load, wherein the active material undergoes a change in a property upon exposure to an activating condition, wherein the change in the property is effective to change an impedance characteristic of the support.

In another embodiment, a tunable impedance load bearing structure includes a support configured for supporting a load including, an upper portion having a first flat surface and a second flat surface, wherein a canted beam element is disposed between the first flat surface and the second flat surface, a first disc comprising an active material in physical communication with the second flat surface of the upper portion, wherein the active material undergoes a change in a property upon exposure to an activating condition, wherein the change in the property is effective to change a compliance characteristic of the support, and a second disc in physical communication with the first disc.

The disclosure may be understood more readily by reference to the following detailed description of the various features of the disclosure and the examples included therein.

BRIEF DESCRIPTION OF THE DRAWINGS

Referring now to the figures wherein the like elements are numbered alike.

DETAILED DESCRIPTION

Active material based tunable impedance load bearing structures and methods of using tunable impedance load bearing structures are disclosed herein. In contrast to prior art load bearing structures, the tunable impedance load bearing structures disclosed herein have portions formed of, or are fabricated entirely from, active materials. The disclosed tunable impedance load bearing structures advantageously use active materials to variously change an impedance characteristic of the support structure, e.g., a compliance or damping property change. The ability to variously change impedance characteristics greatly increases the functionality of the disclosed load bearing structures by improving the capability to meet the demands of different loading conditions and/or situations. As used herein, the term "load bearing structures" is intended to include without limitation, beams, columns, rails, cables, panels, brackets, connectors, mounts, spacers, grommets, and the like, which could be employed to provide support to an external or internal load. The term "active material" as used herein generally refers to a material that exhibits a change in a property such as, without limitation, a change in an elastic modulus, a shape, a dimension, a phase change, a component location, or a shape orientation upon exposure to an activating condition. Suitable active materials include, without limitation, shape memory alloys ("SMAs"; e.g., thermal and stress activated shape memory alloys and magnetic shape memory alloys (MSMA)), electroactive polymers (EAPs) such as dielectric elastomers, ionic polymer metal composites (IPMC), piezoelectric materials (e.g., polymers, ceramics), and shape memory polymers (SMPs), shape memory ceramics (SMCs), baroplastics, magnetorheological (MR) materials (e.g., fluids and elastomers), electrorheological (ER) materials (e.g., fluids, and elastomers), composites of the foregoing active materials with non-active materials, systems comprising at least one of the foregoing active materials, and combinations comprising at least one of the foregoing active materials. Depending on the particular active material, the activating condition can take the form of an activation signal, which can be, without limitation, an electric current, a temperature change, a magnetic field, a chemical activation signal, a mechanical loading or stressing, and the like.

Also, the terms "first", "second", and the like do not denote any order or importance, but rather are used to distinguish one element from another, and the terms "the", "a", and "an" do not denote a limitation of quantity, but rather denote the presence of at least one of the referenced item. Furthermore, all ranges directed to the same quantity of a given component or measurement is inclusive of the endpoints and independently combinable.

Figure 1A:
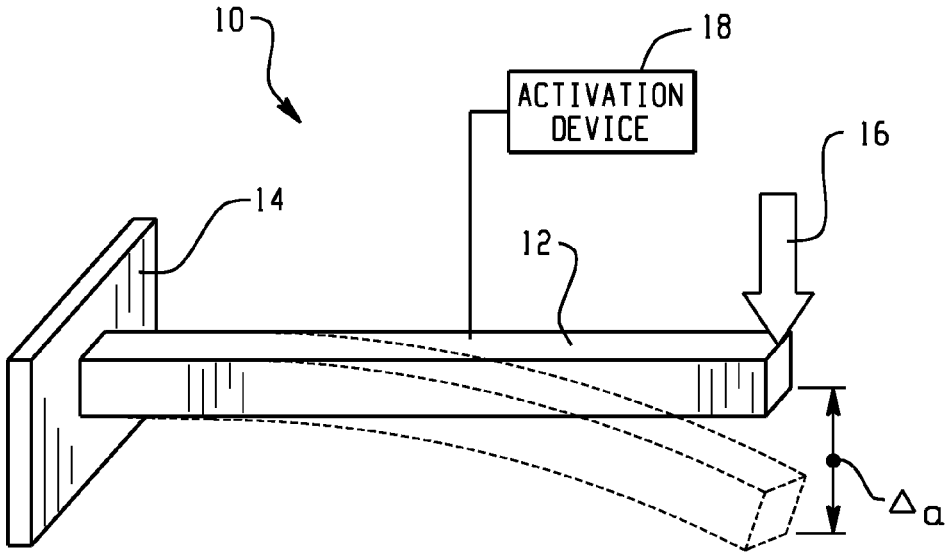
FIG. 1 is an illustration of a perspective view of one embodiment of a tunable impedance load bearing structure showing (a) a load bearing structure in a default state, and (b) an activated load bearing structure.
Figure 1B:
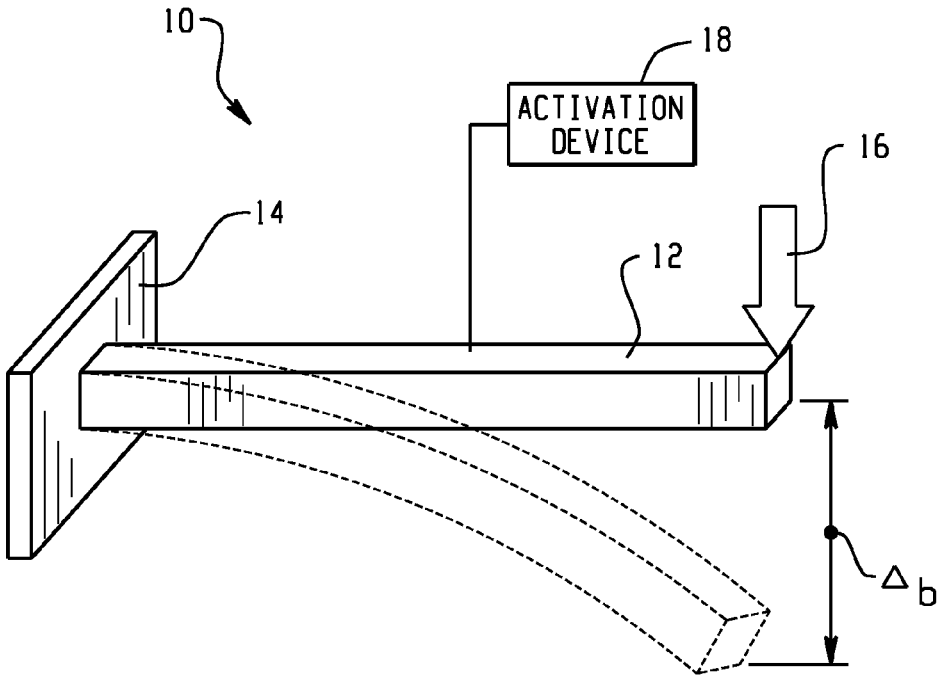

Turning now to FIG. 1, an exemplary embodiment of a tunable impedance load bearing structure 10 is illustrated. In this embodiment, a support 12 takes the form of a cantilever beam, but it is to be understood that the structure may take any form suitable for supporting a load, such as those described above. Also in this embodiment, the entire support, i.e., the cantilever beam 12 is formed of an active material, e.g., a SMP. The cantilever beam 12 is in physical communication with a substrate 14. A force 16, such as an external load, is in physical communication with a free end of the cantilever beam 12.

In operation, the cantilever beam 12 displaces a distance $\Delta_a$ when subjected to the tip force 16, as shown in FIG. 1(*a*). When the active material of the cantilever beam 12 is exposed to an activating condition, the cantilever beam 12 displaces a distance $\Delta_b$ when subjected to the same tip force 16, as shown in FIG. 1(*b*). When the active material is activated, the material undergoes a change in a property, e.g., an elastic modulus. In this case, the modulus of the active material is lowered; therefore, as can be seen in FIG. 1, the displacement distance $\Delta_b$ is greater than the distance $\Delta_a$ when the same force 16 is applied. Conversely, a much smaller tip force would be required to displace the cantilever beam 12 a distance $\Delta_a$ when the active material is exposed to an activating condition. An optional activation device 18 is in operative communication with the load bearing structure 10 and is configured to selectively provide the activation signal to the active material.

Figure 2A:
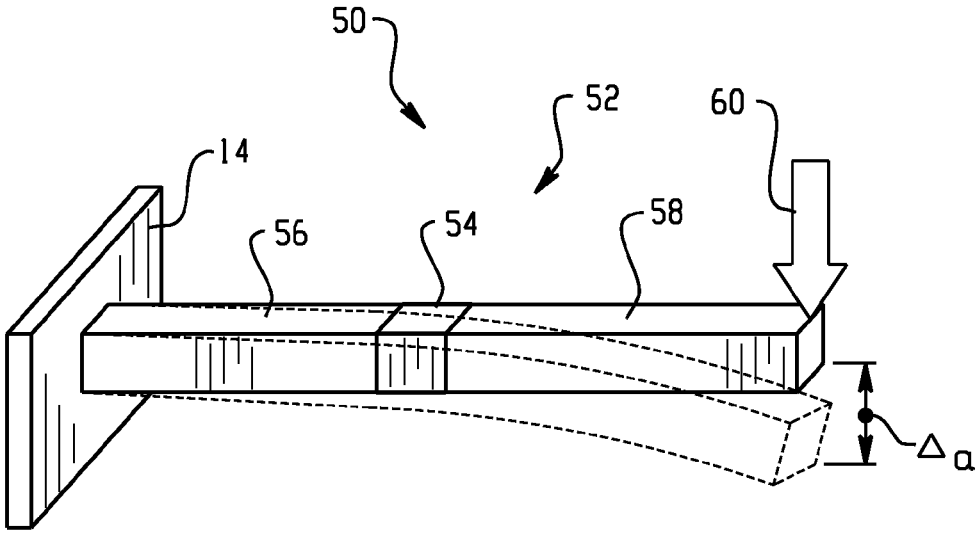
FIG. 2 is an illustration of a perspective view of one embodiment of a tunable impedance load bearing structure showing (a) a load bearing structure in a default state, and (b) a load bearing structure in an activated state.
Figure 2B:
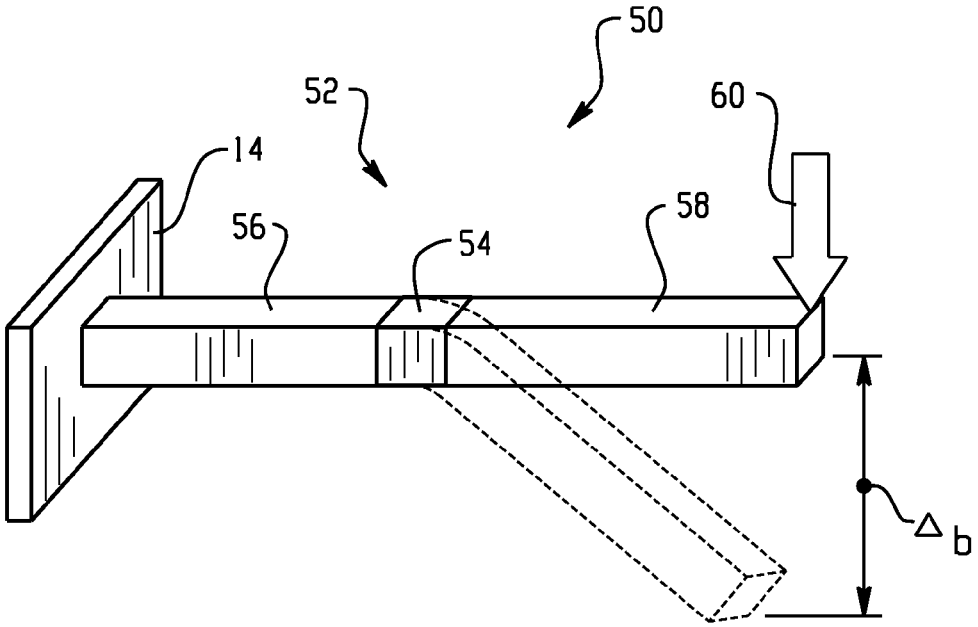

FIG. 2 depicts another exemplary embodiment of a tunable impedance load bearing structure 50. The support 52 again takes the form of a cantilever beam without limitation. In this embodiment, however, the support 52 has a section, e.g., a joint 54, formed of active material, rather than the entire support. The cantilever beam 52, therefore, has three sections. A first portion 56 is in physical communication with a substrate 14 and the active material joint 54, making up the second portion. A third portion 58 forms the end of the cantilever beam 52 and is in physical communication with the active material joint 54. A force 60, such as an external load, is in physical communication with the free end of the second portion 58 of the cantilever beam 52.

In operation, the cantilever beam 52 displaces a distance $\Delta_a$ when subjected to the tip force 60, as shown in FIG. 2(*a*). In this state, i.e., where the active material is not activated, the cantilever beam 52 deflects in the same manner as a homogenous beam. The deformation is distributed along the entire length of the beam 52 to displace a distance $\Delta_a$. When the active material of the joint 54 is exposed to an activating condition, the cantilever beam 52 displaces a distance $\Delta_b$ when subjected to the same force 60, as shown in FIG. 2(*b*). When exposed to the activating condition, the material undergoes a change in a property, e.g., an elastic modulus. In this case, the modulus of the active material joint 54 is lowered to a value below that of the first and third portions 56, 58; therefore, as can be seen in FIG. 2(*b*), the joint 54 deforms locally. The local deformation of the active material joint 54 produces a much larger beam deflection than without the active material activated, and almost no deformation of the inactive first portion 56 and third portion 58 occurs as a result.

Figure 3A:
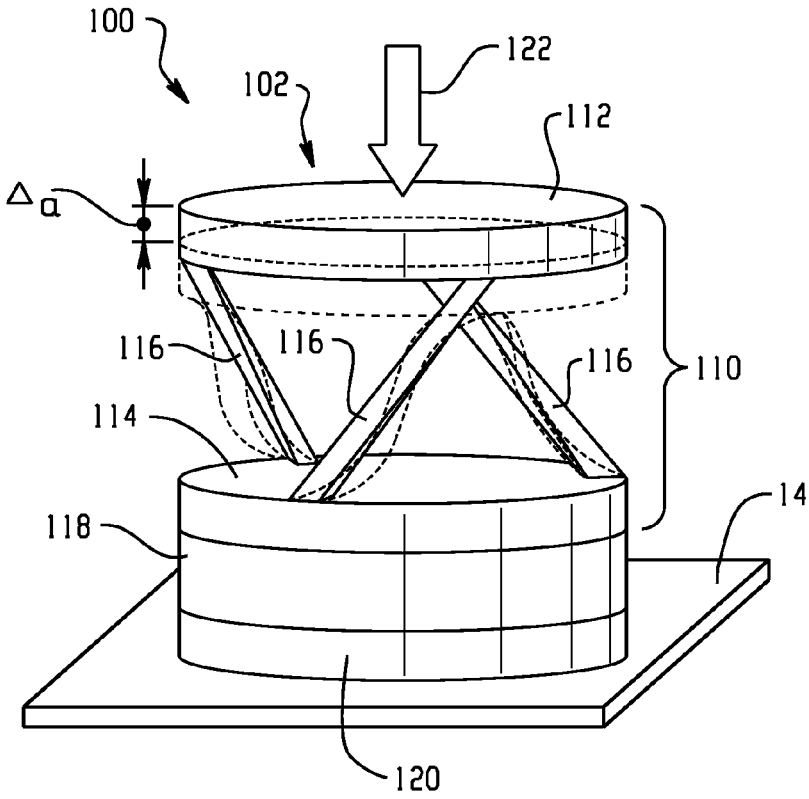
FIG. 3 is an illustration of a perspective view of one embodiment of a tunable impedance load bearing structure showing (a) a load bearing structure in a default state, and (b) an activated load bearing structure.
Figure 3B:
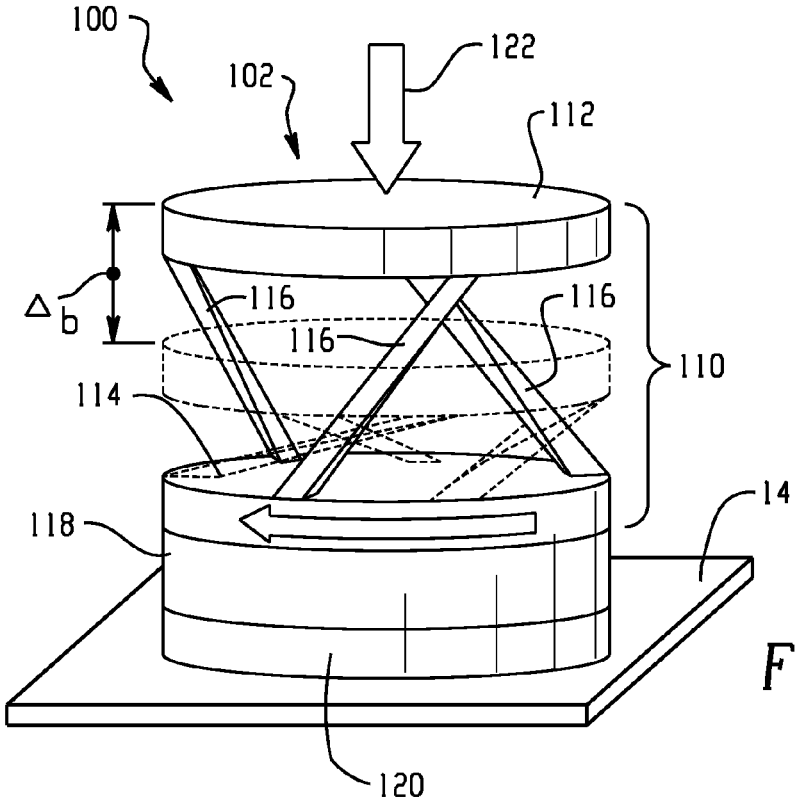

Both the tunable impedance load bearing structures of FIG. 1 and FIG. 2 are embodiments which have active materials located at strategic points within the load bearing structure to control how and where the structure will deform. Turning now to FIG. 3, another exemplary embodiment of a tunable impedance load bearing structure 100 is illustrated, where the change in a property of an active material controls the degree and/or direction of deformation. In this embodiment the support 102 takes the form of a variably complaint column. The column 102 includes an upper portion 110 having a first flat surface 112 and a second flat surface 114. Canted beams 116 are disposed between the first flat surface 112 and the second flat surface 114. A first disc 118 is formed of an active material and is in physical communication with the second flat surface 114 and a second disc 120. The second disc 120 is fixed to a substrate 14. A force 122, such as an external compressive load, is in physical communication with the upper portion 110 of the tunable impedance column 102.

In operation, the column 102 displaces a distance $\Delta_a$ when subjected to the compressive force 122, as shown in FIG. 3(*a*). In this state, i.e., where the active material is not activated, there are negligible deformations within flat surfaces 112 and 115 and the discs 118 and 120. The canted beams 116 bend into an "S" shape. In this deactivated state, the modulus of the column gives the structure stiffness capable of withstanding the force 122. When the active material of the first disc 118 is exposed to an activating condition, the column 100 displaces a distance $\Delta_b$ when subjected to the same force 122, as shown in FIG. 3(*b*). When exposed to the activating condition, the material undergoes a change in a property, e.g., an elastic modulus. The modulus of the active material first disc 118 is lowered to a value below that of the other column components. When the compressive force 122 is applied to the column 100 in this activated state, the deformation is torsional. The activated first disc 118 allows the second flat surface 114 to rotate relative to the first flat surface 112, resulting in the canted beams 116 collapsing on top of one another. Such deformation direction lowers the overall stiffness of the column 102 and results in a displacement $\Delta_b$ greater than that of $\Delta_a$.

Figure 4A:
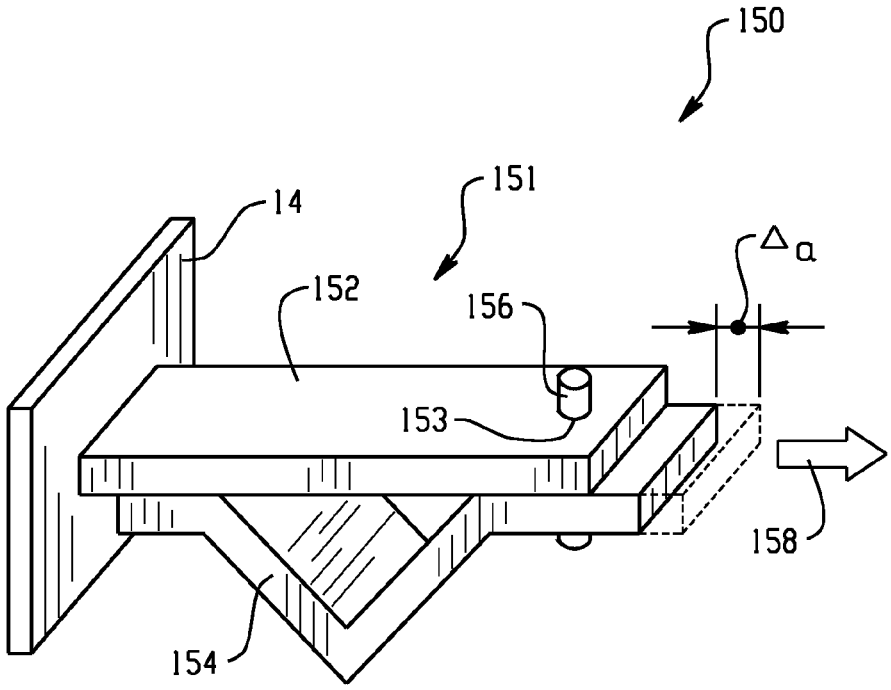
FIG. 4 is an illustration of a perspective view of one embodiment of a tunable impedance load bearing structure showing (a) a load bearing structure in a default state, and (b) an activated load bearing structure.
Figure 4B:
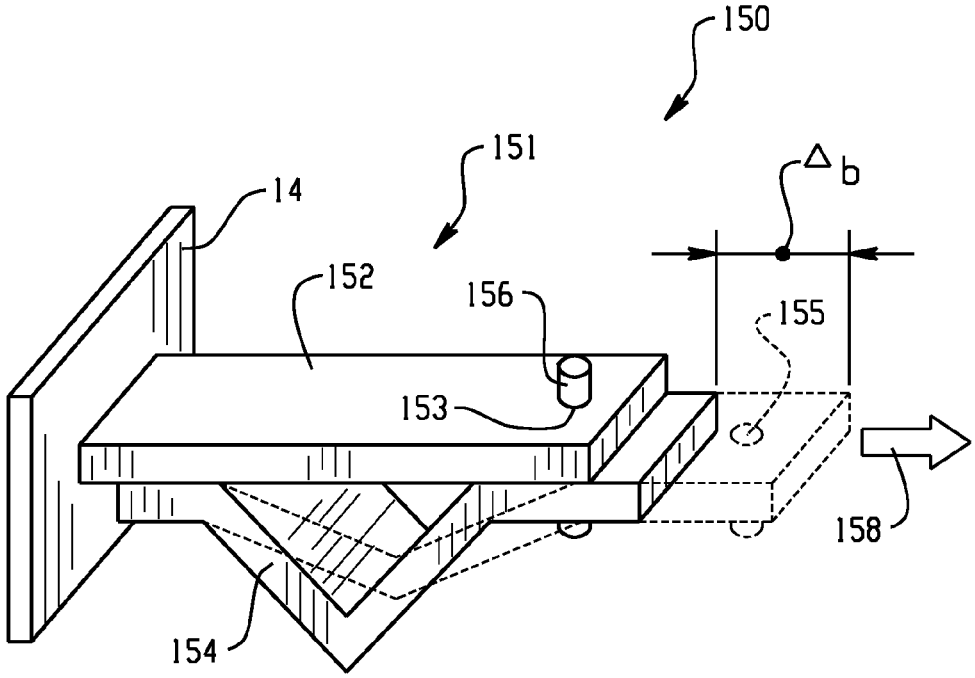

In FIG. 4, yet another exemplary embodiment of a tunable impedance load bearing structure 150 is illustrated. In this embodiment, a change in a property of an active material is capable of altering the load path within the load bearing structure. The support 151 is composed of a flat member 152 fixed to a substrate 14 and in physical communication with an angled member 154. Both members may be formed of an inactive material, such as steel. At one end the flat member 152 and the angled member 154 are rigidly joined. The two members may be joined by a weld, adhesive, bolt, pin, and the like. At the free end of the members 152 and 154, a pin 156 formed of active material is disposed in a first aperture 153 of the flat member 152 and a second aperture 155 of the angled member 154. The pin 156 is in operative communication with flat member 152 and the angled member 154. A force 158, such as an external load, is in physical communication with the support 151.

In operation, the load bearing structure 150 displaces a distance $\Delta_a$ when subjected to the force 158, as shown in FIG. 4(*a*). When the active material pin 156 is in a deactivated state, it has a strength capable of withstanding the force 158 and holding the connection between the flat member 152 and the angled member 154. In this state, a only a small amount of deflection, $\Delta_a$, occurs to angled member 154 as most of the force is supported by the upper flat member 152. When the active material of the pin 156 is exposed to an activating condition, the strength of the pin 156 drastically drops, allowing the same force 122 to elicit failure of the pin 156. As a result of the failure, the load path of the structure 150 is rerouted through the lower angled member 154, which deflects a distance $\Delta_b$, substantially greater than $\Delta_a$, as shown in FIG. 3(*b*). To reiterate, in this embodiment, the active material component of the load bearing structure is situated to alter the load path within the structure upon exposure to an activating condition. Similarly, an in-active pin could be actuated using an active material, leading to the same change in the structure's load path.

As used above, the distances "$\Delta_a$" and "$\Delta_b$" are utilized to show the difference between the deflection distance of a tunable impedance load bearing structure in a deactivated state and a deflection distance in an activated state. The labels "$\Delta_a$" and "$\Delta_b$" are merely used for each figure as a matter of convenience and are not intended to represent equal deflection distances for each separate embodiment of the tunable impedance load bearing structure. Moreover, the tunable impedance load bearing structures disclosed above are mere exemplary embodiments of possible load bearing structures and are not intended to be limited to the above disclosed designs. The tunable impedance load bearing structures can be configured in any suitable shape. Also, the load bearing structures can have a single active material component or can have multiple active material components, with each active material component configured to alter a stiffness, create a crush initiation site, change a degree, direction, or preferred mode of deformation, alter a load path within the structure, any combination of the foregoing, and the like, of a tunable impedance load bearing structure. The ability of the active material based load bearing structures to adapt and comply to changing loads and situations can be beneficial in many applications, such as, without limitation, automotive, aerospace, static structure, and the like.

In yet another mode of operation, the above disclosed tunable impedance load bearing structures can also provide alignment and locking capabilities, useful in applications such as a vehicle manufacturing and assembly processes. The active material based tunable impedance load bearing structure can be activated during the vehicle assembly process, thereby lowering the modulus, for example, and permitting a vehicle body panel, supported by the load bearing structure, to be positioned/aligned relative to a vehicle frame. While in this newly aligned position, cooling the active material of the load bearing structure will cause the active material to stiffen, locking the load bearing structure in the newly aligned position and providing a path to transfer static load on/from the fender to the vehicle frame. Such capability allows the vehicle body to be reversibly realigned throughout the vehicle's life.

When active material of a load bearing structure is exposed to an activating condition, the active material undergoes a change in a property. The changed property can be, without limitation, a shape change, a shape orientation change, a phase change, a change in modulus, a change in strength, a change in dimension, or any combination of the foregoing. The resultant change in property of the active material produces a change in an impedance characteristic of the load bearing structure. Such a change in a compliance characteristic can be, without limitation, a stiffness change, a damping capability change, a yield strength change, a change in force-deflection behavior, a change in load-carrying capacity, a change in energy absorption capacity, any combination of the foregoing, and the like.

Exposing the active material to an activating condition can be done in various ways. An activation device can be used to transmit an activation signal, e.g., a thermal signal, to the active material. The activation device may incorporate sensors which could trigger the activating condition in response to a predetermined event, current or anticipated changes in the operating environment, or allow direct activation of the material though user input. Such an active system could also provide the option of a feedback loop where monitoring the degree of material transformation, geometrical change, and structure integrity of the load bearing structure is possible. Another option could be to have a passive activation system where the active material component of a load bearing structure can be activated by external environmental conditions, e.g. a local temperature change. Another embodiment could include both a passive and active activation system. One example could allow certain active material elements of the structure to be activated passively and other elements to be activated via an activation device. Another example using both passive and active systems could include a passive system to precondition an active material element and an active system to fully activate the active material. As used herein, the term "precondition" generally refers to minimizing the energy required to effect deformation. Using SMP as an example for ease in discussion, the SMP can be maintained at a preconditioning temperature just below the glass transition temperature. In this manner, the activation signal, e.g., a thermal activation signal, requires minimal energy to effect thermal transformation since the transformation temperature is only slightly greater than the preconditioning temperature. As such, preconditioning minimizes the amount of additional heating and time necessary to cause transformation of the SMP, thereby providing a rapid response on the order of a few milliseconds, if desired. In a preferred embodiment, the preconditioning does not cause any transformation of the SMP, unless intentionally designed.

As indicated, the change of impedance characteristics in a tunable impedance load bearing structure occurs through exposure of an active material to an activating condition. For example, in the case of a load bearing structure having a SMP component, a thermal activation signal is required to change the temperature of the SMP. In order to produce the required temperature change, the SMP can be resistively heated, radiatively heated, and/or conductively heated using such means that include, but are not intended to be limited to, conduction from a higher or a lower temperature fluid (e.g., a heated exhaust gas stream), radiative heat transfer, use of thermoelectrics, microwave heating, and the like. Different control algorithms based on a variety of possible sensor inputs could be used to initiate the thermal activation. Various forms of sensor inputs that could be used in deciding whether activation should occur operation and status inputs for the load bearing structure's given application. For instance, in the case of automotive application, vehicle conditions such as speed, yaw rate, ABS operation, weather conditions, etc., prediction of an increasing probability of an imminent loading event, for example, on input from a radar or vision based object detection system, telematics, speed limit signs, and the like), and finally, a signal from an on-board sensor that a loading event has started to occur. The amount of time that is available for thermo-molecular relaxation that underlies the change in modulus in the SMP decreases as the probability of such an event increases. Resistive and pyrotechnic heating means, therefore, are two activation signals that can provide SMP activation times of 0.5 seconds or less.

For tunably compliant load bearing structures based on thermal activation signals, such as may be the case with SMP, maintaining the preconditioning temperature below the transformation temperature may comprise providing a secondary activation signal at a level below that which would normally cause transformation of the SMP. In this manner, a primary activation signal can then be provided to effect deformation, wherein the primary signal would require minimal energy and time. In an alternative embodiment, the environment in which the tunable bracket is disposed can be maintained at a temperature below the transformation temperature. In either embodiment, preconditioning can comprise a temperature sensor and a controller in operative communication with the tunably complaint load bearing structure. A feedback loop may be provided to an activation device so as to provide the secondary activation signal if so configured. Otherwise, the temperature sensor and activation device can precondition the environment to minimize the time to transition the SMP to its transformation temperature by means of the primary activation signal. The preconditioning may be static or transient depending on the desired configuration.

The preconditioning temperature can be greater than about 50 percent of the temperature difference between the ambient temperature and the (lowest) glass transition temperature, with greater than about 80 percent preferred, with greater than about 90 percent more preferred, and with greater than about 95 percent even more preferred.

The activation device can be programmed to cause activation of the active material portion defining the tunable impedance load bearing structure within the desired times suitable for the intended application. For example, the activation device can be programmed to provide either a high current or a low current to a resistive heating element in thermal communication with the active material, e.g., a SMP. The high current could be used to provide rapid irreversible activation whereas the low current could be used to provide delayed reversible activation. The use of the high and low current in the manner described is exemplary and is not intended to limit the programming variety available for the activation device or to define the conditions for reversibility.

Sensor inputs can be varied in nature and number (pressure sensors, position sensors (capacitance, ultrasonic, radar, camera, etc.), displacement sensors, velocity sensors, accelerometers, etc.) and be located on the support substrate, e.g., a vehicle body.

As previously described, suitable active materials for tunable impedance load bearing structures include, without limitation, shape memory alloys ("SMAs"; e.g., thermal and stress activated shape memory alloys and magnetic shape memory alloys (MSMA)), electroactive polymers (EAPs) such as dielectric elastomers, ionic polymer metal composites (IPMC), piezoelectric materials (e.g., polymers, ceramics), and shape memory polymers (SMPs), shape memory ceramics (SMCs), baroplastics, magnetorheological (MR) materials (e.g., fluids and elastomers), electrorheological (ER) materials (e.g., fluids, and elastomers), composites of the foregoing active materials with non-active materials, systems comprising at least one of the foregoing active materials, and combinations comprising at least one of the foregoing active materials. For convenience and by way of example, reference herein will be made to shape memory alloys and shape memory polymers. The shape memory ceramics, baroplastics, and the like, can be employed in a similar manner. For example, with baroplastic materials, a pressure induced mixing of nanophase domains of high and low glass transition temperature (Tg) components effects the shape change. Baroplastics can be processed at relatively low temperatures repeatedly without degradation. SMCs are similar to SMAs but can tolerate much higher operating temperatures than can other shape-memory materials. An example of an SMC is a piezoelectric material.

The ability of shape memory materials to return to their original shape upon the application or removal of external stimuli has led to their use in actuators to apply force resulting in desired motion. Active material actuators offer the potential for a reduction in actuator size, weight, volume, cost, noise and an increase in robustness in comparison with traditional electromechanical and hydraulic means of actuation. Ferromagnetic SMA's, for example, exhibit rapid dimensional changes of up to several percent in response to (and proportional to the strength of) an applied magnetic field. However, these changes are one-way changes and use the application of either a biasing force or a field reversal to return the ferromagnetic SMA to its starting configuration.

Shape memory alloys are alloy compositions with at least two different temperature-dependent phases or polarity. The most commonly utilized of these phases are the so-called martensite and austenite phases. In the following discussion, the martensite phase generally refers to the more deformable, lower temperature phase whereas the austenite phase generally refers to the more rigid, higher temperature phase. When the shape memory alloy is in the martensite phase and is heated, it begins to change into the austenite phase. The temperature at which this phenomenon starts is often referred to as austenite start temperature (As). The temperature at which this phenomenon is complete is often called the austenite finish temperature (Af). When the shape memory alloy is in the austenite phase and is cooled, it begins to change into the martensite phase, and the temperature at which this phenomenon starts is often referred to as the martensite start temperature (Ms). The temperature at which austenite finishes transforming to martensite is often called the martensite finish temperature (Mf). The range between As and Af is often referred to as the martensite-to-austenite transformation temperature range while that between Ms and Mf is often called the austenite-to-martensite transformation temperature range. It should be noted that the above-mentioned transition temperatures are functions of the stress experienced by the SMA sample. Generally, these temperatures increase with increasing stress. In view of the foregoing properties, deformation of the shape memory alloy is preferably at or below the austenite start temperature (at or below As). Subsequent heating above the austenite start temperature causes the deformed shape memory material sample to begin to revert back to its original (nonstressed) permanent shape until completion at the austenite finish temperature. Thus, a suitable activation input or signal for use with shape memory alloys is a thermal activation signal having a magnitude that is sufficient to cause transformations between the martensite and austenite phases.

The temperature at which the shape memory alloy remembers its high temperature form (i.e., its original, nonstressed shape) when heated can be adjusted by slight changes in the composition of the alloy and through thermo-mechanical processing. In nickel-titanium shape memory alloys, for example, it can be changed from above about 100° C. to below about −100° C. The shape recovery process can occur over a range of just a few degrees or exhibit a more gradual recovery over a wider temperature range. The start or finish of the transformation can be controlled to within several degrees depending on the desired application and alloy composition. The mechanical properties of the shape memory alloy vary greatly over the temperature range spanning their transformation, typically providing shape memory effect and superelastic effect. For example, in the martensite phase a lower elastic modulus than in the austenite phase is observed. Shape memory alloys in the martensite phase can undergo large deformations by realigning the crystal structure arrangement with the applied stress. The material will retain this shape after the stress is removed. In other words, stress induced phase changes in SMA are two-way by nature, application of sufficient stress when an SMA is in its austenitic phase will cause it to change to its lower modulus Martensitic phase. Removal of the applied stress will cause the SMA to switch back to its Austenitic phase, and in so doing, recovering its starting shape and higher modulus.

Exemplary shape memory alloy materials include nickel-titanium based alloys, indium-titanium based alloys, nickel-aluminum based alloys, nickel-gallium based alloys, copper based alloys (e.g., copper-zinc alloys, copper-aluminum alloys, copper-gold, and copper-tin alloys), gold-cadmium based alloys, silver-cadmium based alloys, indium-cadmium based alloys, manganese-copper based alloys, iron-platinum based alloys, iron-palladium based alloys, and so forth. The alloys can be binary, ternary, or any higher order so long as the alloy composition exhibits a shape memory effect, e.g., change in shape, orientation, yield strength, flexural modulus, damping capacity, superelasticity, and/or similar properties. Selection of a suitable shape memory alloy composition depends, in part, on the temperature range of the intended application.

The recovery to the austenite phase at a higher temperature is accompanied by very large (compared to that needed to deform the material) stresses which can be as high as the inherent yield strength of the austenite material, sometimes up to three or more times that of the deformed martensite phase. For applications that require a large number of operating cycles, a strain of less than or equal to 4% or so of the deformed length of wire used can be obtained. This limit in the obtainable strain places significant constraints in the application of SMA actuators where space is limited. MSMAs are alloys; often composed of Ni—Mn—Ga, that change shape due to strain induced by a magnetic field. MSMAs have internal variants with different magnetic and crystallographic orientations. In a magnetic field, the proportions of these variants change, resulting in an overall shape change of the material. An MSMA actuator generally requires that the MSMA material be placed between coils of an electromagnet. Electric current running through the coil induces a magnetic field through the MSMA material, causing a change in shape.

As previously mentioned, other exemplary shape memory materials are shape memory polymers (SMPs). "Shape memory polymer" generally refers to a polymeric material, which exhibits a change in a property, such as a modulus, a dimension, a coefficient of thermal expansion, the permeability to moisture, an optical property (e.g., transmissivity), or a combination comprising at least one of the foregoing properties in combination with a change in its a microstructure and/or morphology upon application of an activation signal. Shape memory polymers can be thermoresponsive (i.e., the change in the property is caused by a thermal activation signal delivered either directly via heat supply or removal, or indirectly via a vibration of a frequency that is appropriate to excite high amplitude vibrations at the molecular level which lead to internal generation of heat), photoresponsive (i.e., the change in the property is caused by an electro-magnetic radiation activation signal), moisture-responsive (i.e., the change in the property is caused by a liquid activation signal such as humidity, water vapor, or water), chemo-responsive (i.e. responsive to a change in the concentration of one or more chemical species in its environment; e.g., the concentration of H+ ion—the pH of the environment), or a combination comprising at least one of the foregoing.

Generally, SMPs are phase segregated co-polymers comprising at least two different units, which can be described as defining different segments within the SMP, each segment contributing differently to the overall properties of the SMP. As used herein, the term "segment" refers to a block, graft, or sequence of the same or similar monomer or oligomer units, which are copolymerized to form the SMP. Each segment can be (semi-)crystalline or amorphous and will have a corresponding melting point or glass transition temperature (Tg), respectively. The term "thermal transition temperature" is used herein for convenience to generically refer to either a Tg or a melting point depending on whether the segment is an amorphous segment or a crystalline segment. For SMPs comprising (n) segments, the SMP is said to have a hard segment and (n−1) soft segments, wherein the hard segment has a higher thermal transition temperature than any soft segment. Thus, the SMP has (n) thermal transition temperatures. The thermal transition temperature of the hard segment is termed the "last transition temperature", and the lowest thermal transition temperature of the so-called "softest" segment is termed the "first transition temperature". It is important to note that if the SMP has multiple segments characterized by the same thermal transition temperature, which is also the last transition temperature, then the SMP is said to have multiple hard segments.

When the SMP is heated above the last transition temperature, the SMP material can be imparted a permanent shape. A permanent shape for the SMP can be set or memorized by subsequently cooling the SMP below that temperature. As used herein, the terms "original shape", "previously defined shape", "predetermined shape", and "permanent shape" are synonymous and are intended to be used interchangeably. A temporary shape can be set by heating the material to a temperature higher than a thermal transition temperature of any soft segment yet below the last transition temperature, applying an external stress or load to deform the SMP, and then cooling below the particular thermal transition temperature of the soft segment while maintaining the deforming external stress or load.

The permanent shape can be recovered by heating the material, with the stress or load removed, above the particular thermal transition temperature of the soft segment yet below the last transition temperature. Thus, it should be clear that by combining multiple soft segments it is possible to demonstrate multiple temporary shapes and with multiple hard segments it can be possible to demonstrate multiple permanent shapes. Similarly using a layered or composite approach, a combination of multiple SMPs will demonstrate transitions between multiple temporary and permanent shapes.

The shape memory material may also comprise a piezoelectric material. Also, in certain embodiments, the piezoelectric material can be configured as an actuator for providing rapid deployment. As used herein, the term "piezoelectric" is used to describe a material that mechanically deforms (changes shape) when a voltage potential is applied, or conversely, generates an electrical charge when mechanically deformed. Piezoelectrics exhibit a small change in dimensions when subjected to the applied voltage, with the response being proportional to the strength of the applied field and being quite fast (capable of easily reaching the thousand hertz range). Because their dimensional change is small (e.g., less than 0.1%), to dramatically increase the magnitude of dimensional change they are usually used in the form of piezo ceramic unimorph and bi-morph flat patch actuators which are constructed so as to bow into a concave or convex shape upon application of a relatively small voltage. The morphing/bowing of such patches within the liner of the holder is suitable for grasping/releasing the object held.

One type of unimorph is a structure composed of a single piezoelectric element externally bonded to a flexible metal foil or strip, which is stimulated by the piezoelectric element when activated with a changing voltage and results in an axial buckling or deflection as it opposes the movement of the piezoelectric element. The actuator movement for a unimorph can be by contraction or expansion. Unimorphs can exhibit a strain of as high as about 10%, but generally can only sustain low loads relative to the overall dimensions of the unimorph structure.

In contrast to the unimorph piezoelectric device, a bimorph device includes an intermediate flexible metal foil sandwiched between two piezoelectric elements. Bimorphs exhibit more displacement than unimorphs because under the applied voltage one ceramic element will contract while the other expands. Bimorphs can exhibit strains up to about 20%, but similar to unimorphs, generally cannot sustain high loads relative to the overall dimensions of the unimorph structure.

Exemplary piezoelectric materials include inorganic compounds, organic compounds, and metals. With regard to organic materials, all of the polymeric materials with noncentrosymmetric structure and large dipole moment group(s) on the main chain or on the side-chain, or on both chains within the molecules, can be used as candidates for the piezoelectric film. Examples of polymers include poly(sodium 4-styrenesulfonate) ("PSS"), poly S-119 (Poly(vinylamine) backbone azo chromophore), and their derivatives; polyfluorocarbines, including polyvinylidene fluoride ("PVDF"), its co-polymer vinylidene fluoride ("VDF"), trifluorethylene (TrFE), and their derivatives; polychlorocarbons, including poly(vinylchloride) ("PVC"), polyvinylidene chloride ("PVC2"), and their derivatives; polyacrylonitriles ("PAN"), and their derivatives; polycarboxylic acids, including poly(methacrylic acid ("PMA"), and their derivatives; polyureas, and their derivatives; polyurethanes ("PUE"), and their derivatives; bio-polymer molecules such as poly-L-lactic acids and their derivatives, and membrane proteins, as well as phosphate bio-molecules; polyanilines and their derivatives, and all of the derivatives of tetraamines; polyimides, including Kapton® molecules and polyetherimide ("PEI"), and their derivatives; all of the membrane polymers; poly(N-vinyl pyrrolidone) ("PVP") homopolymer, and its derivatives, and random PVP-co-vinyl acetate ("PVAc") copolymers; and all of the aromatic polymers with dipole moment groups in the main-chain or side-chains, or in both the main-chain and the side-chains; as well as combinations comprising at least one of the foregoing.

Further, piezoelectric materials can include Pt, Pd, Ni, T, Cr, Fe, Ag, Au, Cu, and metal alloys comprising at least one of the foregoing, as well as combinations comprising at least one of the foregoing. These piezoelectric materials can also include, for example, metal oxide such as $SiO_2$, $Al_2O_3$, $ZrO_2$, $TiO_2$, $SrTiO_3$, $PbTiO_3$, $BaTiO_3$, $FeO_3$, $Fe_3O_4$, ZnO, and combinations comprising at least one of the foregoing; and Group VIA and IIB compounds, such as CdSe, CdS, GaAs, $AgCaSe_2$, ZnSe, GaP, InP, ZnS, and combinations comprising at least one of the foregoing.

MR fluids is a class of smart materials whose rheological properties can rapidly change upon application of a magnetic field (e.g., property changes of several hundred percent can be effected within a couple of milliseconds), making them quite suitable in locking in (constraining) or allowing the relaxation of shapes/deformations through a significant change in their shear strength, such changes being usefully employed with grasping and release of objects in embodiments described herein. Exemplary shape memory materials also comprise magnetorheological (MR) and ER polymers. MR polymers are suspensions of micrometer-sized, magnetically polarizable particles (e.g., ferromagnetic or paramagnetic particles as described below) in a polymer (e.g., a thermoset elastic polymer or rubber). Exemplary polymer matrices include poly-alpha-olefins, natural rubber, silicone, polybutadiene, polyethylene, polyisoprene, and combinations comprising at least one of the foregoing.

The stiffness and potentially the shape of the polymer structure are attained by changing the shear and compression/tension moduli by varying the strength of the applied magnetic field. The MR polymers typically develop their structure when exposed to a magnetic field in as little as a few milliseconds, with the stiffness and shape changes being proportional to the strength of the applied field. Discontinuing the exposure of the MR polymers to the magnetic field reverses the process and the elastomer returns to its lower modulus state. Packaging of the field generating coils, however, creates challenges.

MR fluids exhibit a shear strength which is proportional to the magnitude of an applied magnetic field, wherein property changes of several hundred percent can be effected within a couple of milliseconds. Although these materials also face the issues packaging of the coils necessary to generate the applied field, they can be used as a locking or release mechanism, for example, for spring based grasping/releasing.

Suitable MR fluid materials include ferromagnetic or paramagnetic particles dispersed in a carrier, e.g., in an amount of about 5.0 volume percent (vol %) to about 50 vol % based upon a total volume of MR composition. Suitable particles include iron; iron oxides (including $Fe_2O_3$ and $Fe_3O_4$); iron nitride; iron carbide; carbonyl iron; nickel; cobalt; chromium dioxide; and combinations comprising at least one of the foregoing; e.g., nickel alloys; cobalt alloys; iron alloys such as stainless steel, silicon steel, as well as others including aluminum, silicon, cobalt, nickel, vanadium, molybdenum, chromium, tungsten, manganese and/or copper.

The particle size should be selected so that the particles exhibit multiple magnetic domain characteristics when subjected to a magnetic field. Particle diameters (e.g., as measured along a major axis of the particle) can be less than or equal to about 1,000 micrometers (μm) (e.g., about 0.1 micrometer to about 1,000 micrometers), or, more specifically, about 0.5 to about 500 micrometers, and more specifically, about 10 to about 100 micrometers.

The viscosity of the carrier can be less than or equal to about 100,000 centipoise (cPs) (e.g., about 1 cPs to about 100,000 cPs), or, more specifically, about 250 cPs to about 10,000 cPs, or, even more specifically, about 500 cPs to about 1,000 centipoise. Possible carriers (e.g., carrier fluids) include organic liquids, especially non-polar organic liquids. Examples include oils (e.g., silicon oils, mineral oils, paraffin oils, white oils, hydraulic oils, transformer oils, and synthetic hydrocarbon oils (e.g., unsaturated and/or saturated)); halogenated organic liquids (such as chlorinated hydrocarbons, halogenated paraffins, perfluorinated polyethers and fluorinated hydrocarbons); diesters; polyoxyalkylenes; silicones (e.g., fluorinated silicones); cyanoalkyl siloxanes; glycols; and combinations comprising at least one of the foregoing carriers.

Aqueous carriers can also be used, especially those comprising hydrophilic mineral clays such as bentonite or hectorite. The aqueous carrier can comprise water or water comprising a polar, water-miscible organic solvent (e.g., methanol, ethanol, propanol, dimethyl sulfoxide, dimethyl formamide, ethylene carbonate, propylene carbonate, acetone, tetrahydrofuran, diethyl ether, ethylene glycol, propylene glycol, and the like), as well as combinations comprising at least one of the foregoing carriers. The amount of polar organic solvent in the carrier can be less than or equal to about 5.0 vol % (e.g., about 0.1 vol % to about 5.0 vol %), based upon a total volume of the MR fluid, or, more specifically, about 1.0 vol % to about 3.0%. The pH of the aqueous carrier can be less than or equal to about 13 (e.g., about 5.0 to about 13), or, more specifically, about 8.0 to about 9.0.

When the aqueous carriers comprises natural and/or synthetic bentonite and/or hectorite, the amount of clay (bentonite and/or hectorite) in the MR fluid can be less than or equal to about 10 percent by weight (wt %) based upon a total weight of the MR fluid, or, more specifically, about 0.1 wt % to about 8.0 wt %, or, more specifically, about 1.0 wt % to about 6.0 wt %, or, even more specifically, about 2.0 wt % to about 6.0 wt %.

Optional components in the MR fluid include clays (e.g., organoclays), carboxylate soaps, dispersants, corrosion inhibitors, lubricants, anti-wear additives, antioxidants, thixotropic agents, and/or suspension agents. Carboxylate soaps include ferrous oleate, ferrous naphthenate, ferrous stearate, aluminum di- and tri-stearate, lithium stearate, calcium stearate, zinc stearate, and/or sodium stearate; surfactants (such as sulfonates, phosphate esters, stearic acid, glycerol monooleate, sorbitan sesquioleate, laurates, fatty acids, fatty alcohols, fluoroaliphatic polymeric esters); and coupling agents (such as titanate, aluminate, and zirconate); as well as combinations comprising at least one of the foregoing. Polyalkylene diols, such as polyethylene glycol, and partially esterified polyols can also be included.

Electrorheological fluids (ER) fluids are similar to MR fluids in that they exhibit a change in shear strength when subjected to an applied field, in this case a voltage rather than a magnetic field. Response is quick and proportional to the strength of the applied field. It is, however, an order of magnitude less than that of MR fluids and several thousand volts are typically required.

Electronic electroactive polymers (EAPs) are a laminate of a pair of electrodes with an intermediate layer of low elastic modulus dielectric material. Applying a potential between the electrodes squeezes the intermediate layer causing it to expand in plane. They exhibit a response proportional to the applied field and can be actuated at high frequencies. EAP morphing laminate sheets have been demonstrated. Their major downside is that they require applied voltages approximately three orders of magnitude greater than those required by piezoelectrics Electroactive polymers include those polymeric materials that exhibit piezoelectric, pyroelectric, or electrostrictive properties in response to electrical or mechanical fields. An example of an electrostrictive-grafted elastomer with a piezoelectric poly(vinylidene fluoride-trifluoro-ethylene) copolymer. This combination has the ability to produce a varied amount of ferroelectric-electrostrictive molecular composite systems.

Materials suitable for use as an electroactive polymer may include any substantially insulating polymer and/or rubber that deforms in response to an electrostatic force or whose deformation results in a change in electric field. Exemplary materials suitable for use as a pre-strained polymer include silicone elastomers, acrylic elastomers, polyurethanes, thermoplastic elastomers, copolymers comprising PVDF, pressure-sensitive adhesives, fluoroelastomers, polymers comprising silicone and acrylic moieties (e.g., copolymers comprising silicone and acrylic moieties, polymer blends comprising a silicone elastomer and an acrylic elastomer, and so forth).

Materials used as an electroactive polymer can be selected based on material properties such as a high electrical breakdown strength, a low modulus of elasticity (e.g., for large or small deformations), a high dielectric constant, and so forth. In one embodiment, the polymer can be selected such that is has an elastic modulus of less than or equal to about 100 MPa. In another embodiment, the polymer can be selected such that is has a maximum actuation pressure of about 0.05 megaPascals (MPa) and about 10 MPa, or, more specifically, about 0.3 MPa to about 3 MPa. In another embodiment, the polymer can be selected such that is has a dielectric constant of about 2 and about 20, or, more specifically, about 2.5 and about 12. The present disclosure is not intended to be limited to these ranges. Ideally, materials with a higher dielectric constant than the ranges given above would be desirable if the materials had both a high dielectric constant and a high dielectric strength. In many cases, electroactive polymers can be fabricated and implemented as thin films, e.g., having a thickness of less than or equal to about 50 micrometers.

As electroactive polymers may deflect at high strains, electrodes attached to the polymers should also deflect without compromising mechanical or electrical performance. Generally, electrodes suitable for use can be of any shape and material provided that they are able to supply a suitable voltage to, or receive a suitable voltage from, an electroactive polymer. The voltage can be either constant or varying over time. In one embodiment, the electrodes adhere to a surface of the polymer. Electrodes adhering to the polymer can be compliant and conform to the changing shape of the polymer. The electrodes can be only applied to a portion of an electroactive polymer and define an active area according to their geometry. Various types of electrodes include structured electrodes comprising metal traces and charge distribution layers, textured electrodes comprising varying out of plane dimensions, conductive greases (such as carbon greases and silver greases), colloidal suspensions, high aspect ratio conductive materials (such as carbon fibrils and carbon nanotubes, and mixtures of ionically conductive materials), as well as combinations comprising at least one of the foregoing.

Exemplary electrode materials can include graphite, carbon black, colloidal suspensions, metals (including silver and gold), filled gels and polymers (e.g., silver filled and carbon filled gels and polymers), and ionically or electronically conductive polymers, as well as combinations comprising at least one of the foregoing. It is understood that certain electrode materials may work well with particular polymers and may not work as well for others. By way of example, carbon fibrils work well with acrylic elastomer polymers while not as well with silicone polymers.

Magnetostrictives are solids that develop a large mechanical deformation when subjected to an external magnetic field. This magnetostriction phenomenon is attributed to the rotations of small magnetic domains in the materials, which are randomly oriented when the material is not exposed to a magnetic field. The shape change is largest in ferromagnetic or ferromagnetic solids. These materials possess a very fast response capability, with the strain proportional to the strength of the applied magnetic field, and they return to their starting dimension upon removal of the field. However, these materials have maximum strains of about 0.1 to about 0.2 percent.

Advantageously, the above disclosed tunable impedance load bearing structures can permanently or reversibly produce a compliance characteristic change on demand, in response to external stimulus, activation signals generated in response to conditions measured by sensors, or environmental changes, by employing active materials. The active material based load bearing structures can provide large deformations without a significant amount of external loading and limit deflections under significant loads, thereby providing a tuned response depending on existing circumstances and/or preferences. Because of the unique properties of the active materials, all of the above disclosed impedance tuning methods can be implemented and/or controlled while the load bearing structure is in use.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A tunable impedance load bearing structure, comprising:

a first surface;

a second surface;

at least one canted beam disposed between the first surface and the second surface;

a substrate; and an active material operatively interconnecting second surface and the substrate;

wherein the active material undergoes a change in a property upon exposure to an activating condition;

wherein the change in the property is effective to change an impedance characteristic of the load bearing structure;

wherein the load bearing structure is configured such that a compressive load exerted on the first surface causes torsional deformation of the active material; and wherein the active material comprises at least one of a shape memory polymer, a shape memory alloy, a ferromagnetic shape memory alloy, an electroactive polymer, a piezoelectric material, a magnetorheological elastomer, and an electrorheological elastomer.

2. The tunable impedance load bearing structure of claim 1, wherein the change in a property comprises at least one of a change in an elastic modulus, a shape, a dimension, a shape orientation, a component location, and a phase change.

3. The tunable impedance load bearing structure of claim 1, further comprising an activation device in operative communication with the active material to provide the activating condition to the active material, wherein the activating condition comprises at least one of a thermal activation signal, an electric activation signal, a magnetic activation signal, a chemical activation signal, and a mechanical signal.

* * * * *